US005207458A

United States Patent [19]

Treichel et al.

[11] Patent Number: 5,207,458

[45] Date of Patent: May 4, 1993

[54] MULTI-LAYERED LABEL

[75] Inventors: Heinz Treichel, Dormagen; Norbert Schiffer, Rommerskirchen, both of Fed. Rep. of Germany; Franz P. Schüller, Cascais, Portugal

[73] Assignee: Bayer Aktiengesellschaft, Leverkusen, Fed. Rep. of Germany

[21] Appl. No.: 894,701

[22] Filed: Jun. 5, 1992

[30] Foreign Application Priority Data

Jun. 29, 1991 [DE] Fed. Rep. of Germany ... 9108020[U]
Sep. 18, 1991 [DE] Fed. Rep. of Germany ..... 4131002

[51] Int. Cl.[5] ..... B42D 15/00

[52] U.S. Cl. ..... 283/81; 283/56; 40/299; 40/306; 40/310

[58] Field of Search ..... 283/81, 94, 101, 103, 283/105, 56; 40/299, 306, 310, 360, 630, 638; 428/42, 43

[56] References Cited

U.S. PATENT DOCUMENTS 2,321,184 6/1943 Butterworth ..... 428/42 X
3,166,186 1/1965 Karn ..... 428/42
3,226,862 1/1966 Garruk ..... 428/42 X
4,621,837 11/1986 Mack ..... 283/81 X

FOREIGN PATENT DOCUMENTS 0093000 11/1983 European Pat. Off. .
0275525 7/1988 European Pat. Off. .
0382398 8/1990 European Pat. Off. .
8109118 3/1981 Fed. Rep. of Germany .
2192605 1/1988 United Kingdom .

*Primary Examiner*—Mark Rosenbaum
*Assistant Examiner*—Willman Fridig, Jr.
*Attorney, Agent, or Firm*—Sprung Horn Kramer & Woods

[57] ABSTRACT

In the case of a multi-layered label for adhesively affixing to containers, reading information on the top sheet (4) and on intermediate sheets (3) can be facilitated by not only the top sheet (4) having a tear-open perforation (7) at its adhesively bonded right-hand edge region (5), but also top sheet (4) and intermediate sheet (3) having in the left-hand adhesively bonded edge region (8) tear-off perforations (13; 14) by which the sheets (3; 4) can be detached.

5 Claims, 1 Drawing Sheet

MULTI-LAYERED LABEL

The invention relates to a multi-layered label for adhesively affixing to containers, such as bottles, cans, comprising a base sheet which is provided, at the latest during labelling, with a layer of glue on the reverse side, at least one intermediate sheet and a top sheet which are glued to one another in the left-hand edge region with in each case at least one line of glue parallel to the edge, the top sheet extending beyond at least the intermediate sheet with its right-hand edge region and having on the reverse side in this edge region a gluing which is applied at the latest during labelling and being provided on the left next to this gluing with a tear-open perforation.

Such labels are required if lengthy information in the form of printed text or pictures has to be conveyed.

In the case of the multi-layered label described above, after the perforation has been torn open, the intermediate sheet and the top sheet can be opened like the pages of a book. However, this requires the container to which the label is attached being held during reading, which is of course very awkward.

The object is to provide a multi-layered label which permits easier reading of the information at least on the top sheet and intermediate sheet.

This object is achieved in that the top sheet and the intermediate sheet in each case have a tear-off perforation to the right, next to the lines of glue.

It is achieved in this way that, after tearing open the right-hand perforation, the top sheet and the intermediate sheet can be torn off along the left-hand perforations. These sheets can then be taken and conveniently read. The new label can be applied manually —as well as automatically—by automatic label dispensers. Trouble-free application, generally two lines of glue are provided in the left-hand edge region.

Therefore, according to a first embodiment, the base sheet, intermediate sheet and top sheet are glued to one another in the left-hand edge region in each case by two lines of glue, and the tear-off perforations are provided between the two lines of glue, the right-hand lines of the two lines of glue imparting only slight adhesion, for example by spot gluing.

Alternatively to this, the base sheet, intermediate sheet and top sheet are glued to one another in the left-hand edge region in each case by two lines of glue and the tear-off perforations are provided on the right of the two lines of glue.

The first case has the advantage that the printing area is wider than that of the second embodiment; however, when tearing off the sheets, one has to overcome the adhesive force of the gluing without tearing the sheets.

According to a particular embodiment, the top sheet also extends with its right-hand edge region beyond the base sheet.

In this case, this edge region can be adhesively bonded directly to the container, otherwise the top sheet is adhesively bonded by its right-hand edge region to the base sheet.

In the drawing, the novel label is three-dimensionally represented purely diagrammatically in two exemplary embodiments and is explained in further detail below. In the drawing.

Figure 1:
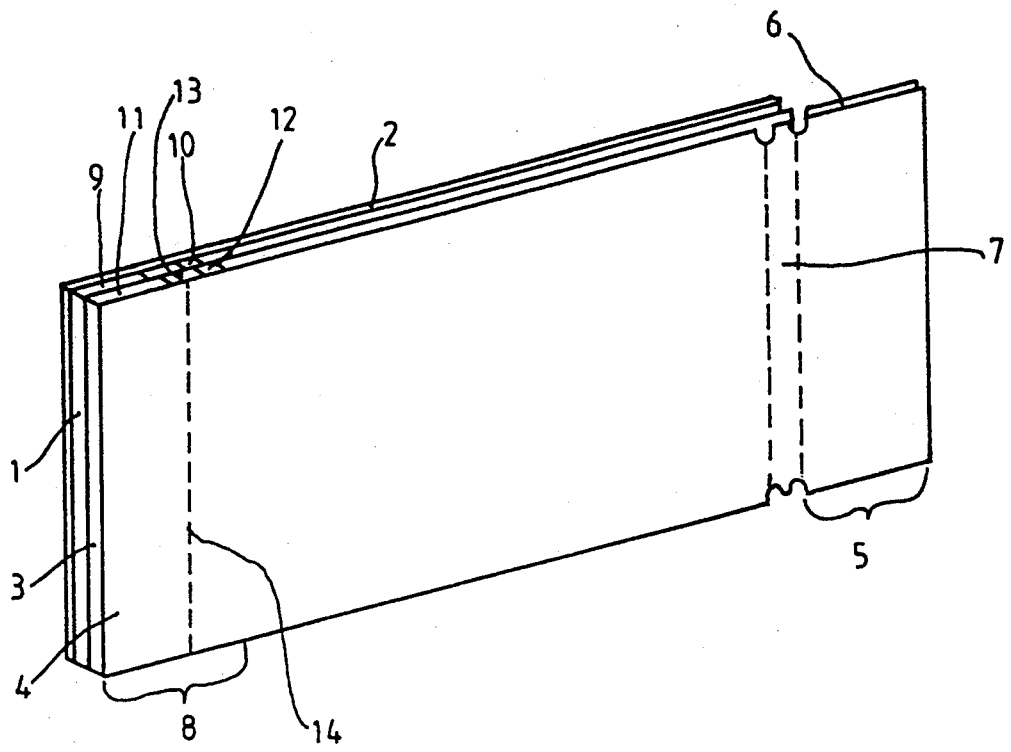
FIG. 1 shows a first embodiment.

In FIG. 1, a base sheet 1 is already provided on the reverse side with a layer of glue 2, by which the label can be adhesively affixed to a container. On the base sheet 1 there is provided an intermediate sheet 3 and above that a top sheet 4, which extends with its right-hand edge region 5 beyond the intermediate sheet 3 and the base sheet 1. The reverse side of this edge region 5 has a gluing 6, by which this edge region 5 can be adhesively bonded directly to the container. To the left of this gluing 6, the top sheet 4 is provided with a tear-open perforation 7. In the left-hand edge region 8, two edge-parallel lines of glue 9 and 10 are arranged between the base sheet 1 and the intermediate sheet 3; lines of glue 11 and 12 are arranged between the intermediate sheet 3 and the top sheet 4. Of these, the two right-hand lines of glue 10 and 12 have only slight adhesion. Between the left-hand lines of glue 9 and 11 on the one hand and the lines of glue 10 and 12 on the other hand, a tear-off perforation 13 is provided in the intermediate sheet 3 and a tear-off perforation 14 is provided in the top sheet 4.

Figure 2:
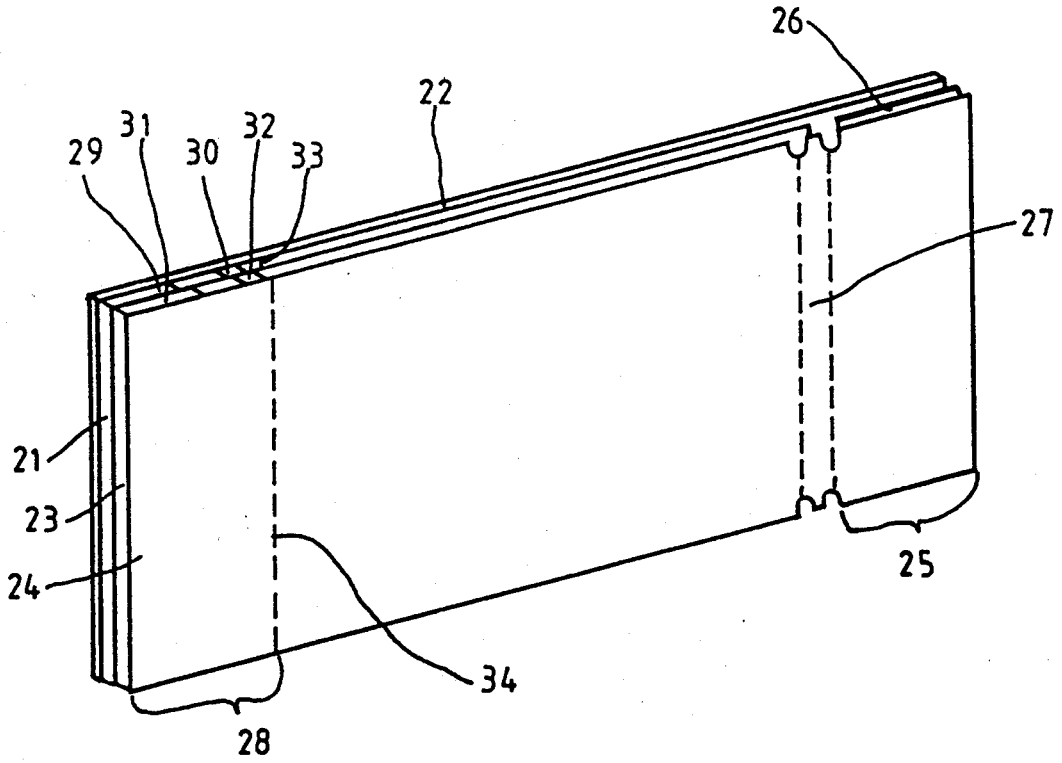
FIG. 2 shows a second embodiment.

In FIG. 2, a base sheet 21 is already provided on the reverse side with a layer of glue 22, by which the label can be adhesively affixed to a container. On the base sheet 21 there is provided an intermediate sheet 23 and above that a top sheet 24. Base sheet 21 and top sheet 24 are of the same width; the intermediate sheet 23 is shorter by the width of the edge region 25. The reverse side of this edge region 25 of the top sheet 24 is adhesively bonded by a gluing 26 to the base sheet 21. To the left of the gluing 26, the top sheet 24 is provided with a tear-open perforation 27. In the left-hand edge region 28, two edge-parallel lines of glue 29 and 30 are arranged between the base sheet 21 and the intermediate sheet 23; two edge-parallel lines of glue 31 and 32 are arranged between the intermediate sheet 23 and the top sheet 24. The intermediate sheet 23 and the top sheet 24 have tear-off perforations 33 and 34, respectively, to the right of the lines of glue 30 and 32, respectively.

We claim:

1. Multi-layered label for adhesively affixing to containers comprising a base sheet (1) having a left-hand edge region (8), at least one intermediate sheet (3) having a left-hand edge region (8) and a right-hand edge region (5), and a top sheet (4) having a left-hand edge region (8), a right-hand edge region (5), and a tear-open perforated strip (7) wherein the intermediate sheet is between the base sheet and the top sheet;

the base sheet has a layer of glue (2) on the side opposite the intermediate and top sheets;

the base sheet, intermediate sheet and top sheet are glued to one another in their respective left-hand edge regions by at least one edge line of glue (9, 11) and optionally at least one second line of glue (10, 12), each line being parallel to the left-hand edge of said sheets and being the only points on the top sheet and the intermediate sheet that are glued to one another;

the top sheet (4) and the intermediate sheet (3) have tear-off perforations (13, 14) to the right of the edge line of glue (9, 11); and the right-hand edge (5) of the top sheet extends beyond the intermediate sheet and has a layer of glue (67) to the right of the tear-open perforated strip (7) on a side of the right-hand edge region that faces the container.

2. Multi-layer label according to claim 1 wherein the left-hand edge regions (8) of the base sheet, intermediate sheet, and top sheet are glued to one another by the edge line of glue (9, 11) and the second lines of glue (10, 12) wherein the second lines of glue provide only slight adhesion.

3. Multi-layered label according to claim 1 wherein the right-hand edge region (5) of the top sheet (4) extends beyond the base sheet (1).

4. Multi-layered label for adhesively affixing to containers comprising a base sheet (21) having a left-hand edge region (28), at least one intermediate sheet (23) having a left-hand edge region (28) and a right-hand edge region (25), and a top sheet (24 having a left-hand edge region (28), a right-hand edge region (25), and a tear-open perforated strip (27) wherein the intermediate sheet is between the base sheet and the top sheet;

the base sheet has a layer of blue (22) on the side opposite the intermediate and top sheets;

the base sheet, intermediate sheet and top sheet are glued to one another in their respective left-hand edge regions by at least one edge line of glue (29, 31) and optionally at least one second line of glue (30, 32), each line being parallel to the left-hand edge of said sheets and being the only points on the top sheet and the intermediate sheet that are glued to one another;

the top sheet (24) and the intermediate sheet (23) have tear-off perforations (33, 34) to the right of the edge line of glue (29, 31); and the right-hand edge (25) of the top sheet extends beyond the intermediate sheet and has a layer of glue (26) to the left of the tear-open perforated strip (27) on a side of the right-hand edge region that faces the container.

5. Multi-layer label according to claim 4 wherein the left-hand edge regions (28) of the base sheet, intermediate sheet, and top sheet are glued to one another by the edge line of glue (29, 31) and two second lines of glue (30, 32) wherein the tear-off perforations (33, 34) are to the right of the edge and second lines of glue.

* * * * *